US006722414B2

(12) United States Patent
Nien

(10) Patent No.: US 6,722,414 B2
(45) Date of Patent: Apr. 20, 2004

(54) BLIND WITH ITS FABRIC DRAPERY STRUCTURE

(76) Inventor: Jerry Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 12 days.

(21) Appl. No.: 10/166,112

(22) Filed: Jun. 11, 2002

(65) Prior Publication Data

US 2003/0226646 A1 Dec. 11, 2003

(51) Int. Cl.[7] ..... A47H 1/00
(52) U.S. Cl. ..... 160/123; 160/89
(58) Field of Search ..... 160/330, 345, 160/123, 38, 39, 344, 89; 248/265, 257, 256, 258, 259, 260, 253, 263, 269, 270, 271, 272; 16/94 D, 95 D, 96 D; 211/105.5, 105.6

(56) References Cited

U.S. PATENT DOCUMENTS 1,868,439 A * 7/1932 Zielinski ..... 211/105.6
2,225,281 A * 12/1940 Speranza ..... 248/265
2,242,683 A * 5/1941 Scott ..... 248/265 X
2,870,918 A * 1/1959 Grubbs ..... 211/105.6
2,974,805 A * 3/1961 Brosseau ..... 211/105.5
3,506,135 A * 4/1970 Klingaman ..... 211/105.6
4,599,763 A * 7/1986 Toder ..... 16/94 D

* cited by examiner

*Primary Examiner*—David Purol

(57) ABSTRACT

A blind with its fabric drapery structure has an upper beam, two rotation units, two spring mounts, two springs, two sealing caps, two connectors, a fabric drapery mounting rod, a fabric drapery hanging track, and two double-sided adhesive pieces. Both ends of the upper beam are engaged with connecting sections of the rotation units, and the spring mounts with the springs are joined to engagement sections of the rotation units. The sealing caps are inserted at one end of said spring mounts. The rotation units engaged with the upper beam are slid in an angle onto the connectors fixed to the frame walls adjacent to a window via the double-sided adhesive pieces, and adjusted in a straight line by pushing inwards to be located thereto. The upper beam serves to display a blind, and the fabric drapery mounting rod and/or the hanging track are connected to the connectors.

10 Claims, 7 Drawing Sheets

BLIND WITH ITS FABRIC DRAPERY STRUCTURE

BACKGROUND OF THE INVENTION

The present invention is related to a blind with its fabric drapery structure, comprising an upper beam, two rotation units, two spring mounts, two springs, two sealing caps, two connectors, a fabric drapery mounting rod, a fabric drapery hanging track, and two double-sided adhesive pieces wherein said rotation units are engaged with said upper beam at one end and said spring mounts with springs received therein at the other ends. The sealing caps inserted to said spring mounts at one end are joined to said rotation units with a properly spaced compression section disposed at the joint thereof. The rotation units can be slid in an angle onto said connectors properly fixed to the frame wall of a window via said double-sided adhesive pieces, and further pushed for location. Via the rebound of said compressed springs, the sealing caps will be abutted tightly against said connectors, while the rotation units will be advanced at the compression section thereof for further secure engagement. Either said fabric drapery mounting rod or the hanging track thereof can be adapted onto the connectors thereof for different ways of displaying said fabric drapery thereof; otherwise, a blind can be applied onto the upper beam for use.

Please refer to FIGS. 1, 2. A conventional blind or fabric drapery structure is simply designed for the use of a blind 1 or a fabric drapery 2 respectively. Each of the structure thereof is provided with an upper beam served only for the use of a blind or a fabric drapery separately. Besides, accessory tools are required to assemble the conventional blind or fabric drapery structure, which is troublesome as well as time-consuming. Thus, such conventional blind or fabric drapery structure is not only one-dimensional in use, but also uneconomic in assembly.

SUMMARY OF THE PRESENT INVENTION

It is, therefore, the primary purpose of the present invention to provide a blind with its fabric drapery structure, which can be easily and quickly assembled without any more accessory tools, boosting the convenience of the blind with fabric drapery structure thereof in use.

It is, therefore, the secondary purpose of the present invention to provide a blind with its fabric drapery structure wherein, besides an upper beam served for the display of a blind, either a fabric drapery mounting rod or a fabric drapery hanging track can be adapted onto a pair of connectors engaged with two rotation units and the upper beam thereof for different ways of displaying said fabric drapery thereof for variety.

It is, therefore, the third purpose of the present invention to provide a blind with its fabric drapery structure, which is multi-functional in use and economical in assembly.

DETAILED DESCRIPTION OF THE PREFERRED EMBODIMENTS

Figure 1:
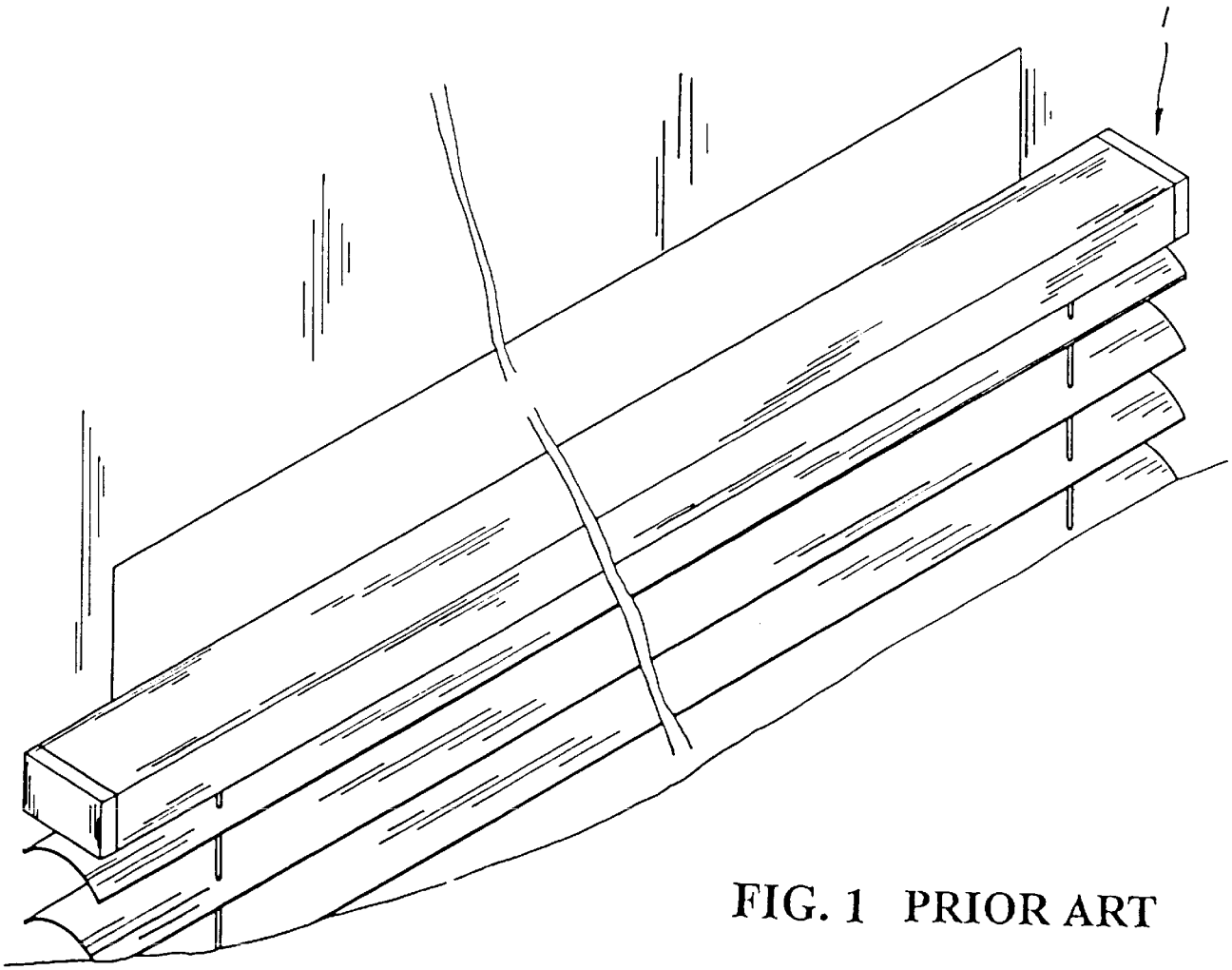
FIG. 1 PRIOR ART
FIG. 1 is a perspective view of a conventional blind structure.
Figure 2:
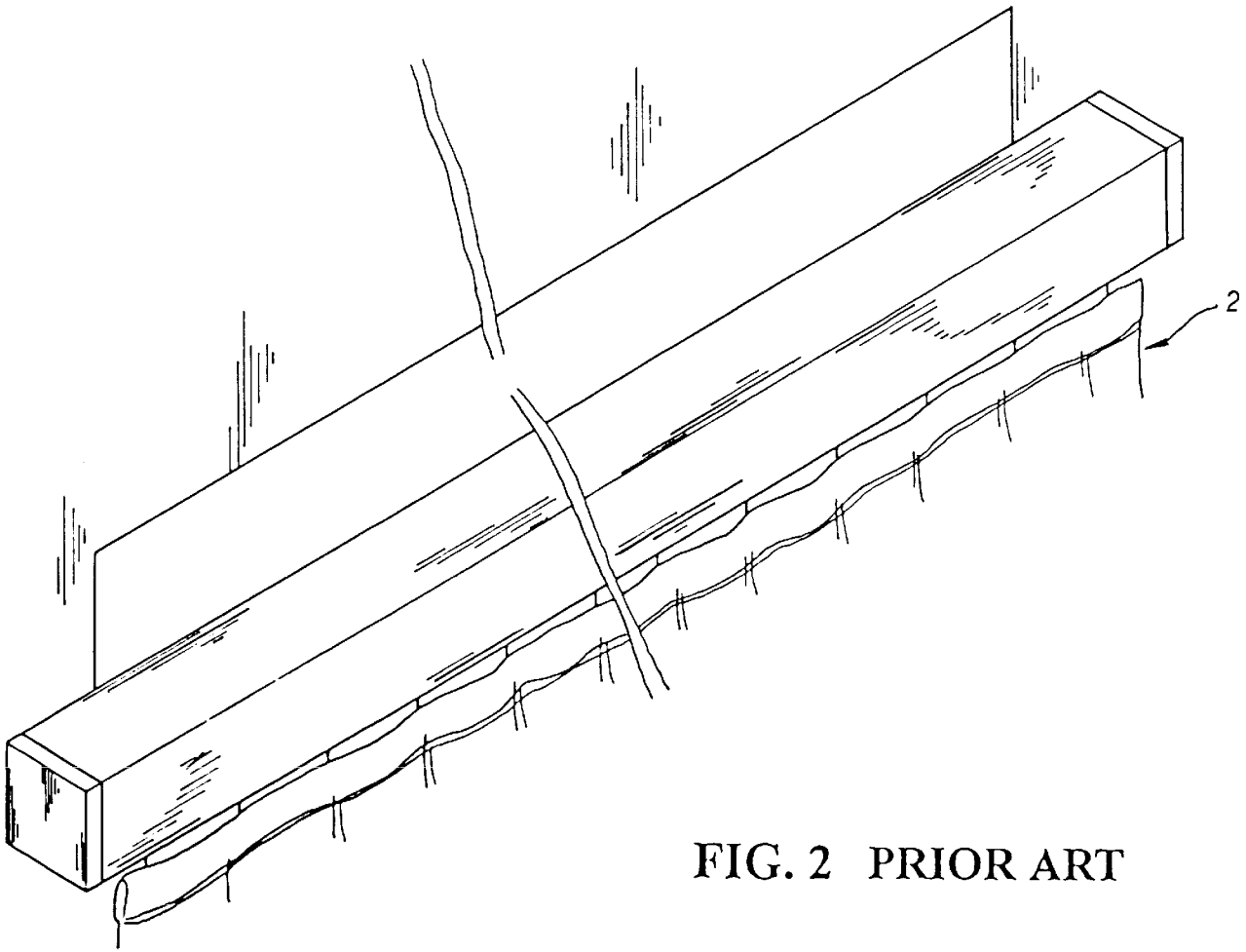
FIG. 2 PRIOR ART
FIG. 2 is a perspective view of a conventional fabric drapery structure.
Figure 3:
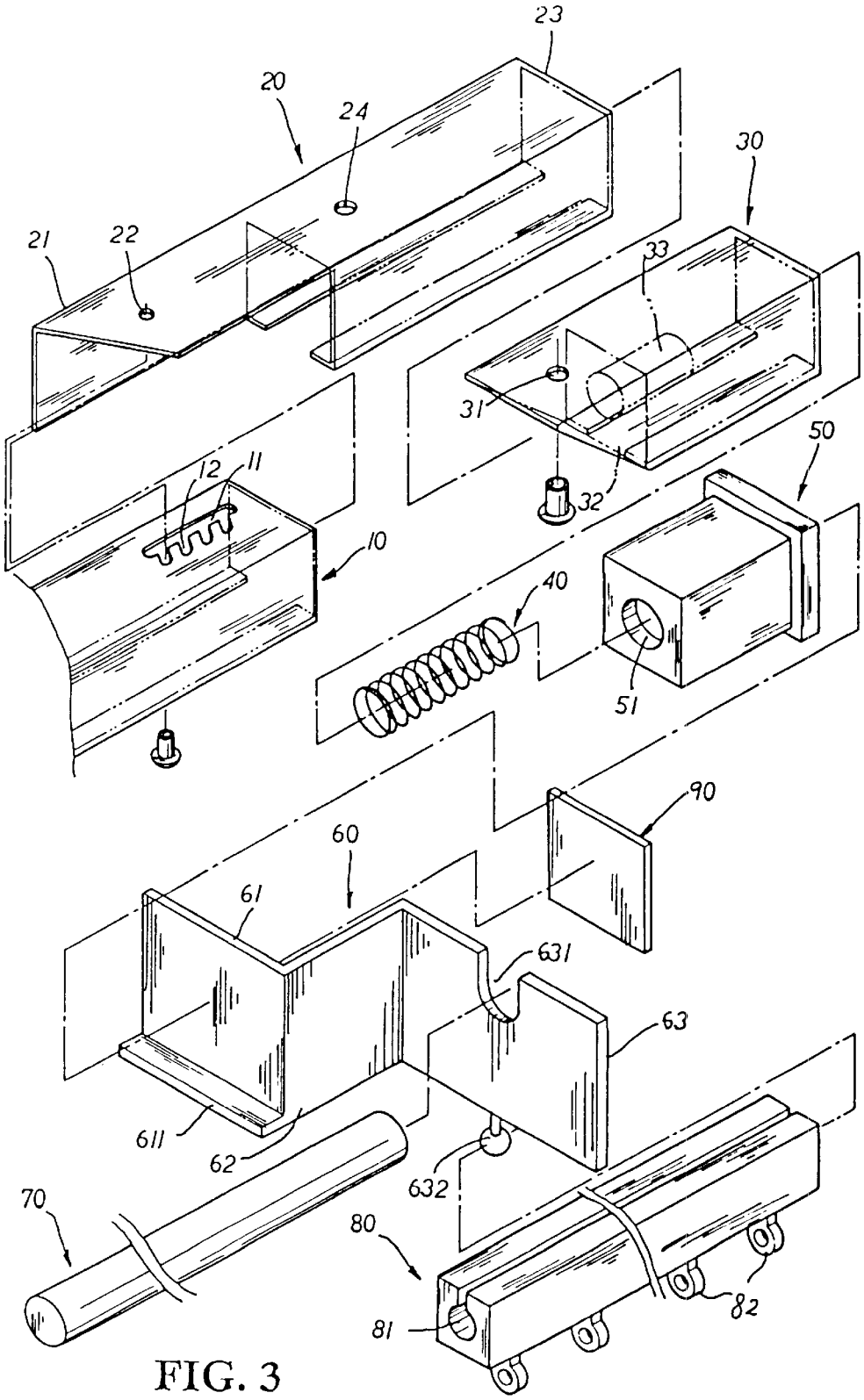
FIG. 3 is a perspective exploded view of the present invention.

Please refer to FIG. 3. The present invention is related to a blind with its fabric drapery structure, comprising an upper beam 10, two rotation units 20, two spring mounts 30, two springs 40, two sealing caps 50, two connectors 60, a fabric drapery mounting rod 70, a fabric drapery hanging track 80, and two double-sided adhesive pieces 90.

The upper beam 10, an inverted U-shaped elongated body, is equipped with a pair of slide locating grooves 11, each having four slant retaining protrusions 12 extending downwards to the central line thereof, disposed at both ends at the top inner side thereof. One end of each rotation unit 20 is equipped with an L-shaped connecting section 21 with a pivot hole 22 disposed at the top side thereof, and the other end thereof has a U-shaped engagement section 23 with a through hole 24 disposed at the top side thereof. Each spring mount 30, a trapezoid frame body, has a rivet hole 31 disposed at the top side thereof, a closed wall 32 disposed at one inner side thereof, and a cylindrical column 33 extending at the interior thereof from one side of said closed wall 32 thereof. Each sealing cap 50, a T-shaped block, is provided with a deep cavity 51 of proper depth at one end thereof. Each connector 60 is made up of a base plate 62 with a small elongated plate 61 and a large elongated plates 63 extending vertically in a right angle at both wings thereof, forming a Z-shaped bracket thereof wherein the small elongated plate 61 has an abutting flange 611 extending transversely at the bottom edge thereof, and the large elongated plate 63 is provided with a U-shaped recess 631 at the top side thereof and a ball-shaped support 632 attached to the central bottom side thereof. The fabric drapery hanging track 80 has a ball-shaped registration groove 81 disposed at the top thereof, and a multiple of equidistant ring hooks 82 disposed at the bottom thereof.

Figure 4:
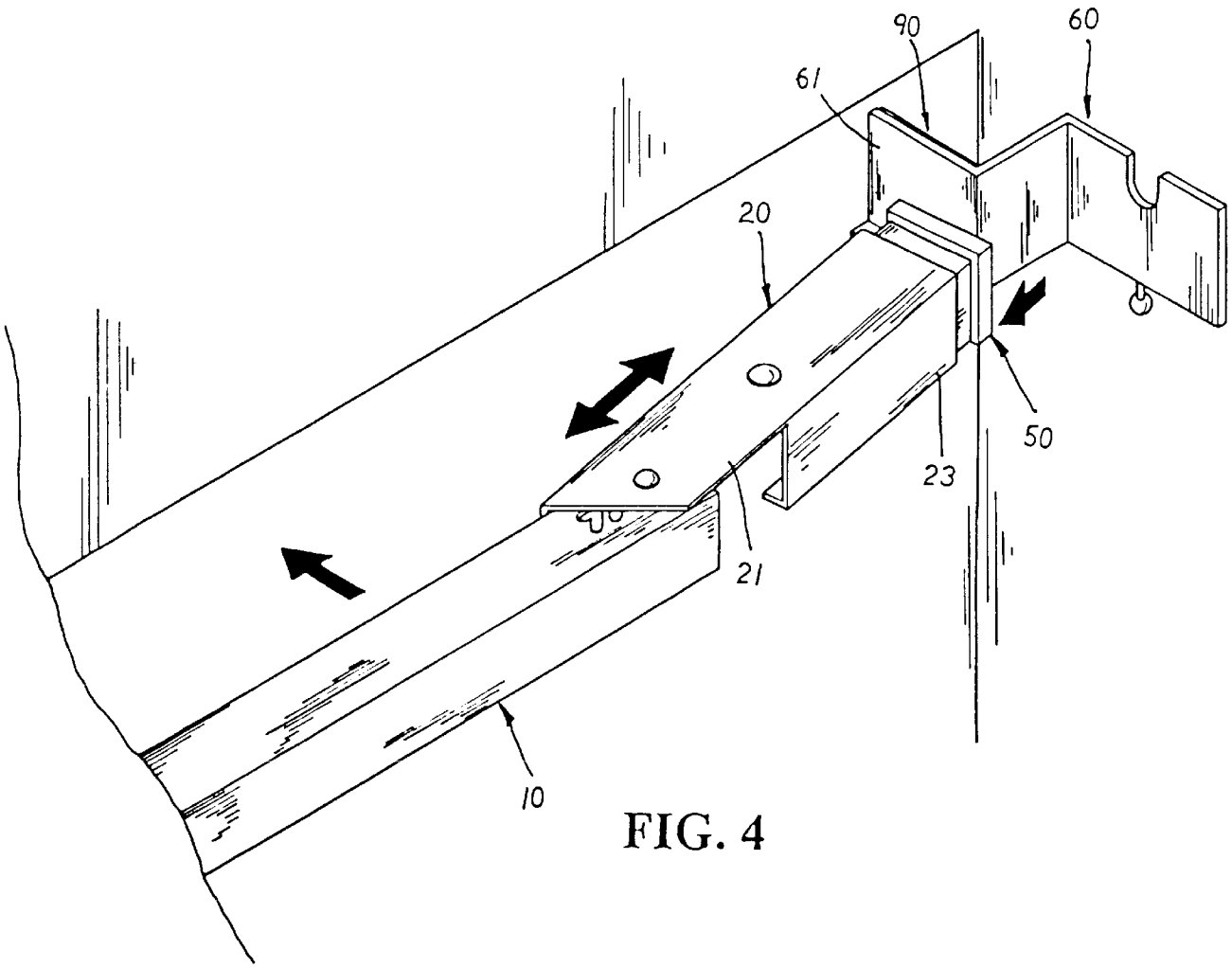
FIG. 4 is perspective view showing the present invention adapted onto the frame wall of a window in half assembly.

Please refer to FIG. 4. In assembly, the connecting section 21 of each rotation unit 20 is joined to one end of the upper beam 10 thereof and pivotally engaged thereto via a rivet led through the slide locating groove 11 of the upper beam 10 and the pivot hole 22 of the rotation unit 20 thereof. Each spring mount 30 is led through the engagement section 23 of the rotation unit 20 and fixedly engaged thereto via another rivet led through the rivet hole 31 of the spring mount 30 thereof and the through hole 24 of the rotation unit 20 thereof. The spring 40 is sleeve joined to the cylindrical column 33 of the spring mount 30 thereof, and sealing cap 50 is inserted onto the spring mount 30 from the other side of closed wall 32 thereof with one end of the spring 40 received at the cavity 51 thereof. The sealing cap 50 is thus joined to the rotation unit 20 via the spring mount 30 thereof with a properly spaced compression section disposed at the joint thereof. The small elongated plate 61 of each connector 60 is applied onto the frame wall adjacent to the lateral sides of a window and fixedly fastened thereto at a proper height via one of the double-sided adhesive piece 90 thereof. The rotation units 20 engaged with the upper beam 10 at one end thereof are slid in an angle onto the connectors 60 thereof and located thereto via both sealing caps 60 thereof whose big ends being abutted against the small elongated plates 61 thereof and whose bottom edges of the big ends thereof retained by the abutting flanges 611 of the connectors 60 thereof. The upper beam 10 engaged with the rotation units 20 at both ends thereof is then pushed from the front and adjust into a straight line, further locating the rotation units 20 thereof fixedly onto the connectors 60 to complete the assembly.

Figure 5:
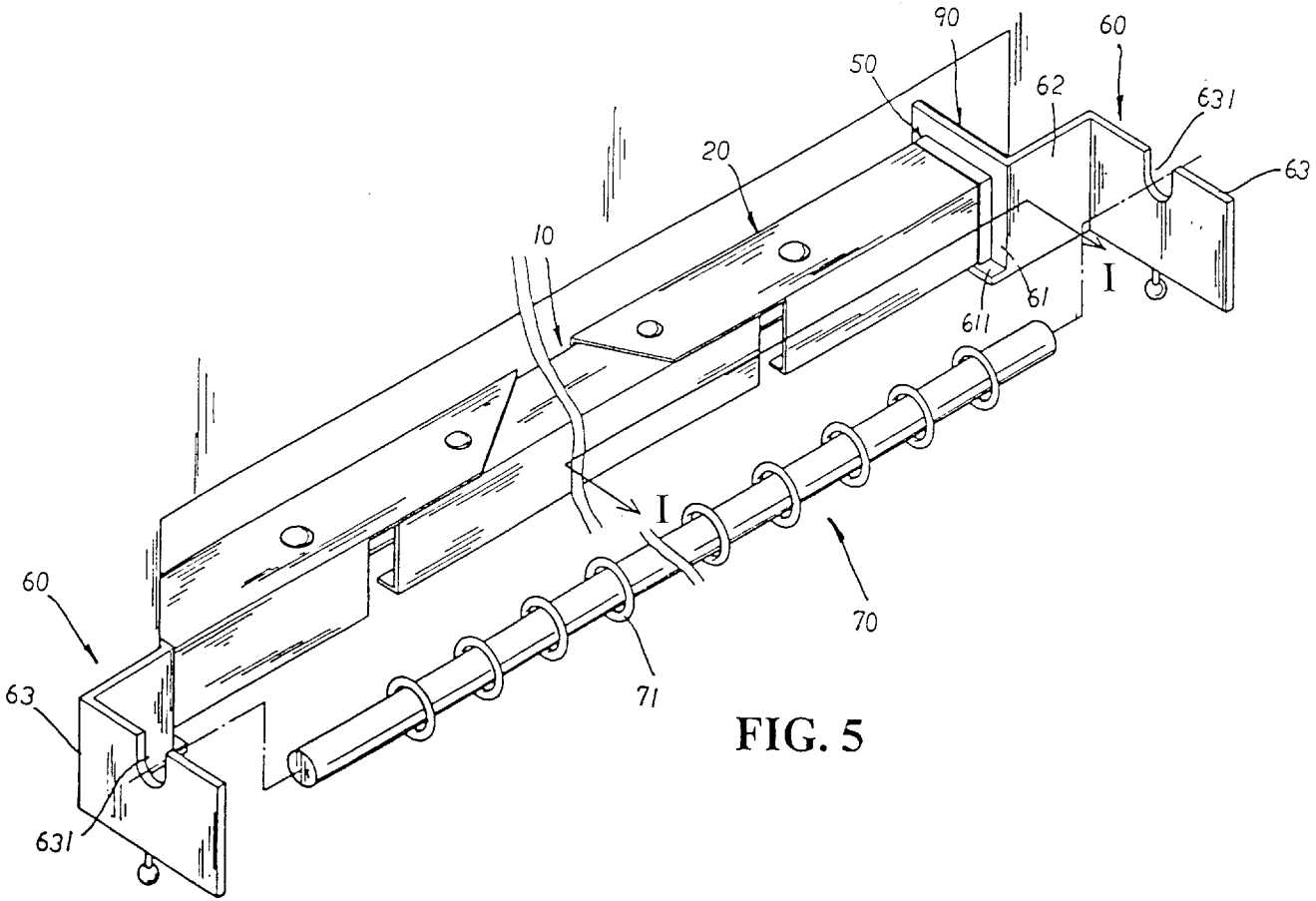
FIG. 5 is a perspective view of the present invention in assembly with a fabric drapery mounting rod applied thereto.
Figure 6:
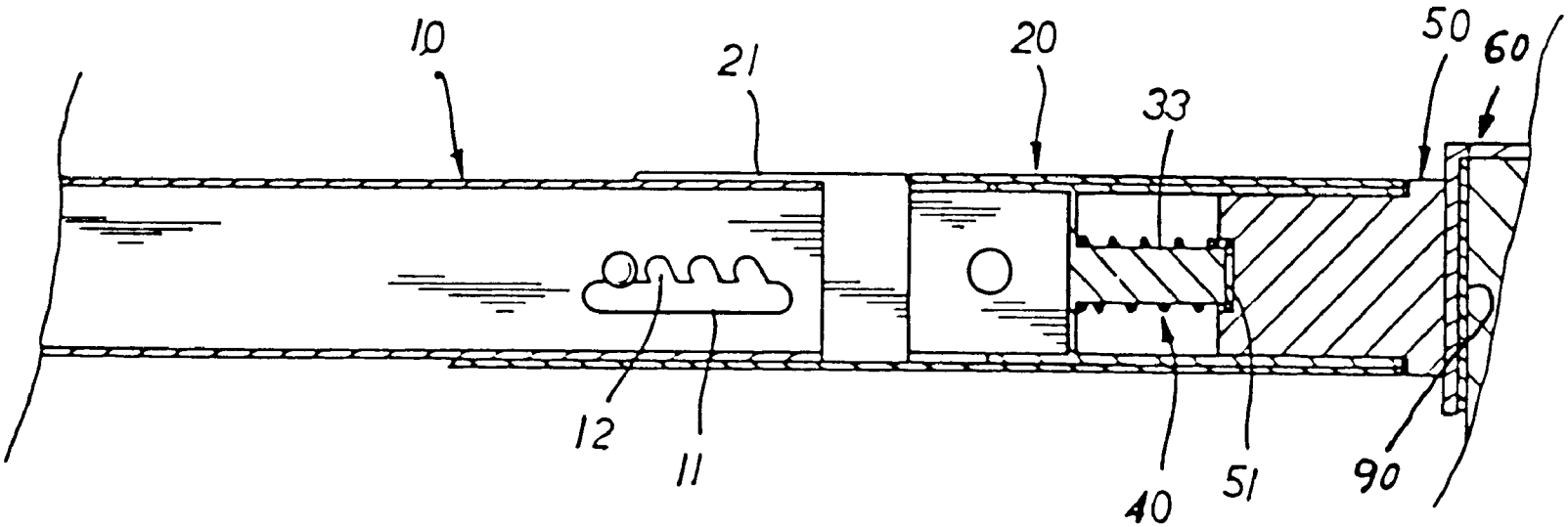
FIG. 6 is a sectional view showing I—I of FIG. 5 from the bottom side thereof.

Please refer to FIG. 6 showing a sectional view of I—I of FIG. 5 from the bottom side thereof. When the rotation units 20 are brought inwards in the adjustment thereof, the rivet engaging the connecting section 21 and the upper beam 10 and temporary held by the slant retaining protrusions 12 thereof will be guided at the slide locating groove 11 therein to be located at a proper position defined by the retaining protrusions 12 thereof. The sealing caps 50 engaged with the rotation units 20 at one end thereof will press tight the springs 40 located at the cavities 51 thereof. Via the rebound of the compressed springs 40, the sealing caps 50 will be pushed outwards to abut tightly against the small elongated plates 61 while said rotation units are further pushed and advanced at the compression section of the joint thereof for secure engagement with the connectors 60 thereof for use.

Figure 7:
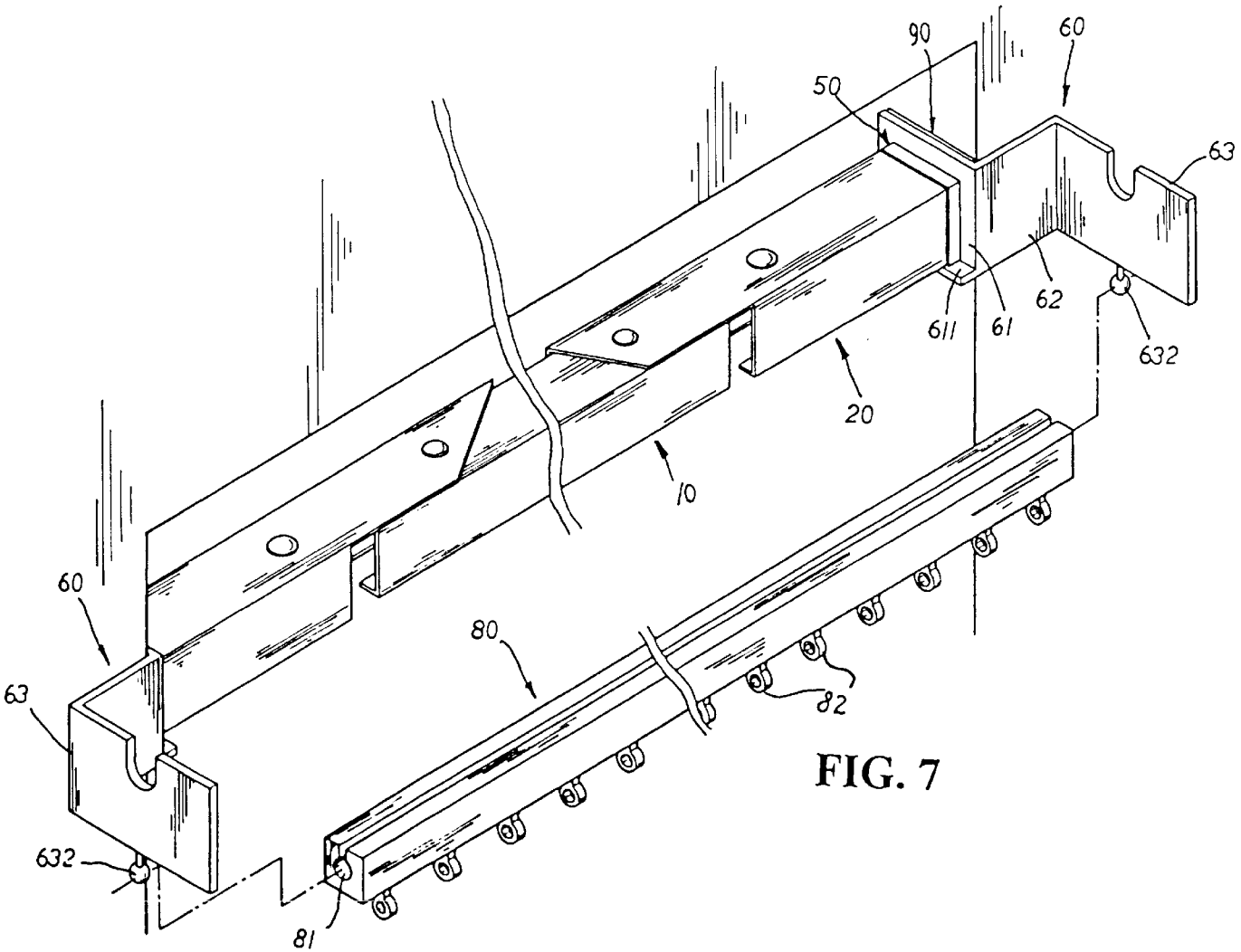
FIG. 7 is a perspective view of the present invention in assembly with a fabric drapery hanging track mounted thereon.

Please refer to FIG. 5. A multiple of rings 71, each attached to a fabric drapery at one side thereof, are led through the fabric drapery mounting rod 70 one by one. The fabric drapery mounting rod 70 with the rings 71 mounted thereon is located at the U-shaped recesses 631 of the big elongated plates 63 thereof and retained by the connectors 60 at both ends thereof for use. Please refer to FIG. 7. In another case, the ball-shaped registration groove 81 disposed at the top of the fabric drapery hanging track 80 is engaged with the ball-like supports 632 disposed at the central bottom of the big elongated plates 63 thereof to fixedly secure the fabric drapery hanging track 80 onto the connectors 60 thereof. The ring hooks 82 disposed at the bottom side of the hanging track 80 thereof are then attached to a fabric drapery for display. Besides the display of a fabric drapery via the fabric drapery mounting rod 70 and the fabric drapery hanging track 80 thereof, a blind can also be attached to the upper beam 10 thereof for display as well.

What is claimed is:

1. A support structure for a blind and fabric comprising:

a) an upper beam having two slide grooves positioned on opposing ends thereof, each slide groove having a plurality of slant retaining protrusions, such that the blind is connected to the upper beam;

b) two rotation units, each rotation unit having:

i) a connecting section, the connecting section being pivotally and adjustably connected to one of the plurality of slant retaining protrusions in one of the two slide grooves in the upper beam; and ii) an engagement section;

c) two spring mounts, each spring mount having a closed end with a cylindrical portion, the cylindrical portion is connected to the closed end within an interior of each spring mount, each spring mount connected to the engagement section of one of the two rotation units;

d) two springs, the cylindrical portion of each of the two spring mounts is inserted into a first end of each spring;

e) two sealing caps, each sealing cap slidably inserted into one of the two spring mounts, wherein each sealing cap slidable engages a second end of one of the two springs;

f) two connectors, each connector including:

i) a small elongated plate with an abutting flange;

ii) a large elongated plate having a U-shaped recess on a top edge and a ball-shaped support on a bottom edge; and iii) a base plate formed between the small elongated plate and the large elongated plate; and g) a fabric drapery rod having a plurality of rings, opposing ends of the drapery rod are inserted into the U-shaped recesses in the two connectors.

2. The support structure for a blind and fabric according to claim 1, further comprising a fabric drapery track having a ball-shaped registration groove on a top and a plurality of spaced apart hooks on a bottom, wherein the ball-shaped supports of the two connectors are inserted into the ball-shaped registration groove.

3. The support structure for a blind and fabric according to claim 1, further comprising two double-sided adhesive pieces, each of the double-sided adhesive pieces connected to one of the two connectors.

4. The support structure for a blind and fabric according to claim 3, wherein the plurality of slant retaining protrusions in each of the two slide grooves of the upper beam includes four slant retaining protrusions.

5. The support structure for a blind and fabric according to claim 3, wherein each of the two sealing caps has a deep cavity into which one of the two springs is inserted.

6. A support structure for a blind and fabric comprising:

a) an upper beam having two slide grooves positioned on opposing ends thereof, each slide groove having a plurality of slant retaining protrusions, such that the blind is connected to the upper beam;

b) two rotation units, each rotation unit having:

i) a connecting section, the connecting section being pivotally and adjustably connected to one of the plurality of slant retaining protrusions in one of the two slide grooves in the upper beam; and ii) an engagement section;

c) two spring mounts, each spring mount having a closed end with a cylindrical portion, the cylindrical portion is connected to the closed end within an interior of each spring mount, each spring mount connected to the engagement section of one of the two rotation units;

d) two springs, the cylindrical portion of each of the two spring mounts is inserted into a first end of each spring;

e) two sealing caps, each sealing cap slidably inserted into one of the two spring mounts, wherein each sealing cap slidable engages a second end of one of the two springs;

f) two connectors, each connector including:

i) a small elongated plate with an abutting flange;

ii) a large elongated plate having a U-shaped recess on a top edge and a ball-shaped support on a bottom edge; and iii) a base plate formed between the small elongated plate and the large elongated plate; and g) a fabric drapery track having a ball-shaped registration groove on a top and a plurality of spaced apart hooks on a bottom, wherein the ball-shaped supports of the two connectors are inserted into the ball-shaped registration groove.

7. The support structure for a blind and fabric according to claim 3, further comprising a fabric drapery rod having a plurality of rings, opposing ends of the drapery rod are inserted into the U-shaped recesses in the two connectors.

8. The support structure for a blind and fabric according to claim 3, further comprising two double-sided adhesive pieces, each of the double-sided adhesive pieces connected to one of the two connectors.

9. The support structure for a blind and fabric according to claim 3, wherein the plurality of slant retaining protrusions in each of the two slide grooves of the upper beam includes four slant retaining protrusions.

10. The support structure for a blind and fabric according to claim 3, wherein each of the two sealing caps has a deep cavity into which one of the two springs is inserted.

* * * * *